United States Patent [19]

Cruysberghs

[11] Patent Number: 5,011,047

[45] Date of Patent: Apr. 30, 1991

[54] DISPENSING APPARATUS

[75] Inventor: Rudiger Cruysberghs, Rijkevorsel, Belgium

[73] Assignee: I.P.R.S., Luxembourg

[21] Appl. No.: 577,900

[22] Filed: Sep. 5, 1990

[51] Int. Cl.[5] ..... B65D 83/66

[52] U.S. Cl. ..... 222/396; 222/399

[58] Field of Search ..... 222/396, 399; 169/85; 137/509

[56] References Cited

U.S. PATENT DOCUMENTS

| | | | |
|---|---|---|---|
| 2,950,846 | 8/1960 | Clark et al. | 222/399 |
| 3,258,163 | 6/1966 | Brush | 222/399 |
| 3,322,304 | 5/1967 | Wilson | 222/399 |
| 3,460,555 | 8/1969 | Puster | 222/399 |
| 3,613,954 | 10/1971 | Bayne | 222/399 |
| 3,708,089 | 1/1973 | Holder et al. | 222/396 |
| 3,815,793 | 6/1974 | Morane et al. | 222/399 |
| 3,955,720 | 5/1976 | Malone | 222/396 |
| 4,147,283 | 4/1979 | Mascia et al. | 222/399 |
| 4,310,108 | 1/1982 | Motoyama et al. | 222/399 |
| 4,441,632 | 4/1984 | Stoody | 222/399 |

FOREIGN PATENT DOCUMENTS

| | | | |
|---|---|---|---|
| 2277938 | 2/1976 | France | 222/399 |

*Primary Examiner*—Michael S. Huppert
*Assistant Examiner*—Kenneth Bomberg
*Attorney, Agent, or Firm*—Warren B. Kice

[57] ABSTRACT

An apparatus for dispensing product from a container in which first and second members are provided in a vessel which is disposed in the container. The first member defines with the vessel a first chamber, and the second member defines with the first member a second chamber. One of the members moves in response to the pressure in the container to a first position relative to the other member and pressure is exerted in the second chamber on said first member to move it to a second position in response to the pressure in the container decreasing below the predetermined pressure. When the first member moves to the second position the first chamber is connected with the container to permit the pressurized gas in the first chamber to pass to the container and when the first member moves to the first position this connection is disconnected to prevent the passage of the gas.

42 Claims, 3 Drawing Sheets

DISPENSING APPARATUS

BACKGROUND OF THE INVENTION

This invention relates to a dispensing apparatus and, more particularly, to such an apparatus for dispensing a liquid product from a sealed container.

Liquefied fluorocarbon gases, such as those sold under trade name of Freon, have been used as propellants to discharge a liquid product from a container such as a can, a bottle, a beer keg, a soft drink dispensing machine, or the like. Liquefied fluorocarbon gas exists in the container as a liquid and often can be mixed with the product to be dispensed. Since the vapor pressure of the liquefied fluorocarbon gas exceeds atmospheric pressure at a temperature in which the product is discharged, and since the pressure in the container is substantially equal to the vapor pressure of the liquefied fluorocarbon gas and is independent of the volume of the free space of the container, the pressure of the container will be virtually constant throughout the discharge life of the system as long as the liquefied fluorocarbon gas is present in the container. However, fluorocarbons have adverse effects on the atmosphere and have even been banned in some jurisdictions.

Although other systems have been used which do not require the use of fluorocarbons, their vapor pressure is such that the product cannot be dispensed at a constant pressure through the life of the product. Therefore some type of manual actuation is required prior to dispensing which is costly and inconvenient.

SUMMARY OF THE INVENTION

It is therefore an object of the present invention to provide an apparatus for dispensing product from a container which does not depend on fluorocarbons.

It is a further object of the present invention to provide a dispensing apparatus of the above type in which the product can be dispensed from the container at virtually constant pressure throughout the discharge life of the product.

It is a further object of the present invention to provide a dispensing apparatus of the above type which can utilize an inert gas, such as air or nitrogen, to propel the product from the container.

It is a still further object of the present invention to provide a dispensing apparatus of the above type which requires no manual actuation prior to dispensing.

Toward the fulfillment of these and other objects, the apparatus of the present invention features a vessel disposed in the container for receiving a cylinder in which a piston reciprocates in response to changes in pressure in the container caused by dispensing of the product. When the piston is at a first predetermined position relative to the cylinder in response to the pressure in the container being at a predetermined value, flow of the inert gas into the container is prevented. When the piston attains a second position relative to the cylinder in response to pressure in the container being reduced as a result of dispensing the product, relative high pressure gas from the vessel is discharged into the container to maintain a constant pressure in the container.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
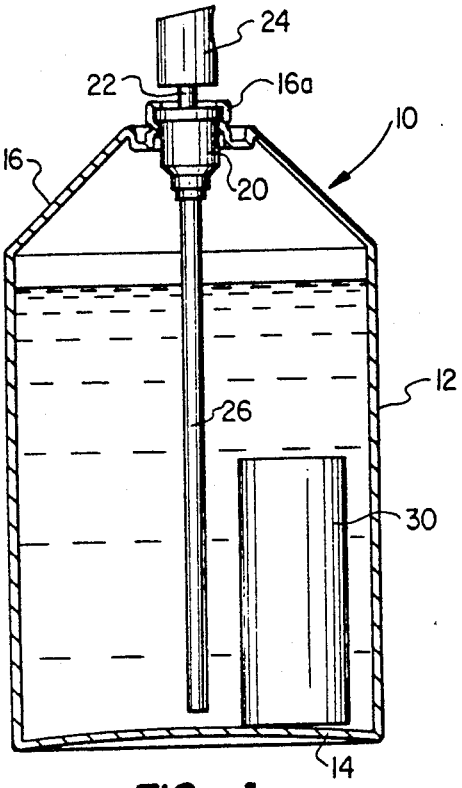
FIG. 1 is a front elevational view, partially in section, depicting the dispensing apparatus of the present invention.

Referring to FIG. 1 of the drawings, the reference numeral 10 refers in general to a container, or can, having a cylindrical wall 12 closed at its lower end by a bottom plate 14 and at its upper end by a cap 16.

The cap 16 has a raised central portion **16*a* which receives a valve 20. A hollow actuating stem 22 extends from the valve 20 and through an opening formed through the raised cap portion 16*a* and receives a hollow push button 24. A tube 26 is disposed in the can in a coaxial relationship therewith. The lower end of the tube 26 is slightly spaced from the bottom plate 14 and the upper end extends into the valve 20. The valve 20 is normally closed but when the push button 24 is manually pushed downwardly, the valve opens to connect the tube 26 with the stem 22. This permits product in the can to flow through the tube 26, the valve 20, the stem 22 and to the push button 24** from which it discharges outwardly through discharge openings in the push button, as will be explained. Since these components are conventional they will not be described in any further detail.

Figure 2A:
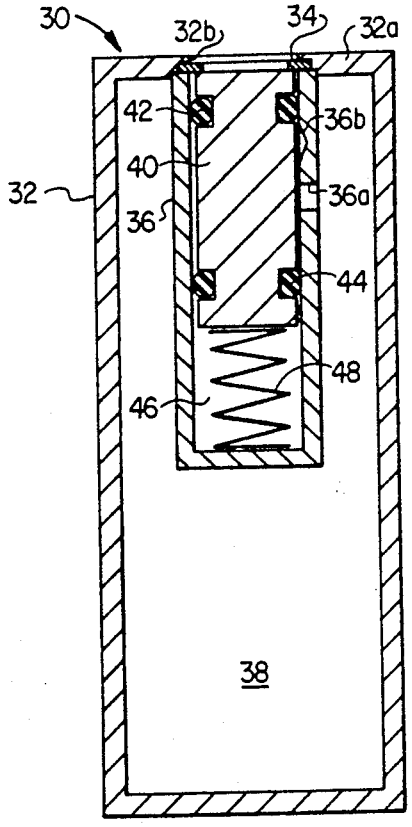
FIGS. 2A–2C are enlarged sectional views of the actuator device of the apparatus of FIG. 1 shown in different operating modes.
Figure 2B:
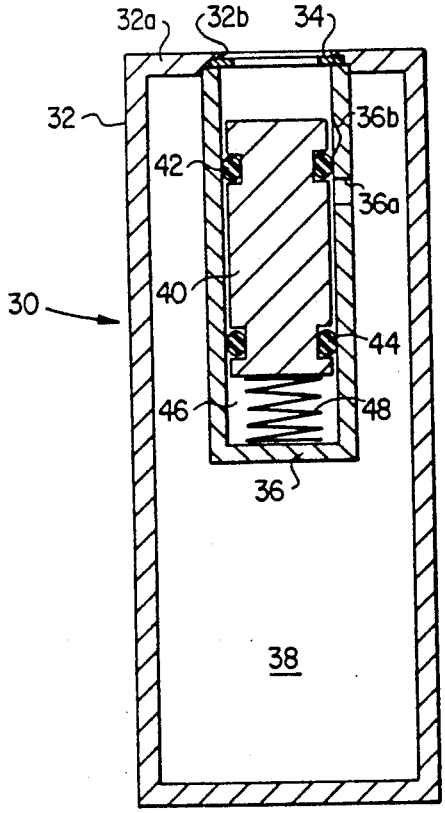
Figure 2C:
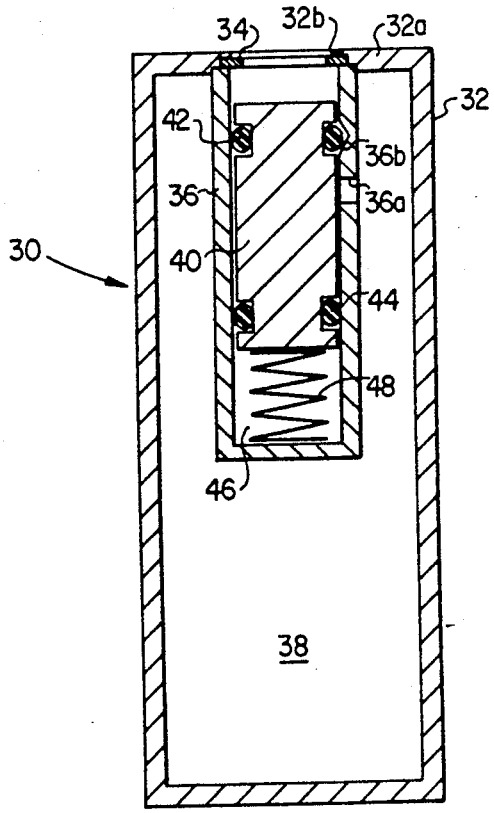

An actuator is disposed in the can 10, and is shown in general by the reference numeral 30 in FIG. 1 and more specifically in connection with FIGS. 2A–2C. Referring to FIG. 2A, the actuator 30 is formed by a vessel 32 having a closed lower end portion and an annular flange **32*a* formed at its upper end and defining an opening 32*b* extending therethrough. An annular notch is formed in the inner wall of the flange 32*a* which is adapted to receive a locating disc 34**.

A cylinder 36 is disposed in the vessel and has a closed lower end and a open upper end. The upper end is secured in a notch formed in the inner wall of the flange **32*a*. The diameter and the length of the cylinder 36 are less than the diameter and length, respectively, of the vessel 32 to define a chamber 38**.

An opening **36*a* is provided through the wall of the cylinder 36 and a notch, or groove, 36*b* is formed in the inner surface of the cylinder and extends above the opening 36*a*, for reasons to be described. A piston 40 operates within the cylinder 36 and the outer diameter of the piston is slightly less than the inner diameter of the cylinder to permit reciprocal movement of the piston in the cylinder and to define a flow passage therebetween. Two axially spaced annular grooves are provided near the respective ends of the piston 40 and receive two sealing members, preferably in the form of O-rings, 42 and 44. The cross-section of each O-ring 42 and 44 is less than that of the corresponding cross-section of the notch 36*b***, for reasons to be described.

A chamber 46 is defined between the respective lower ends of the piston 40 and the cylinder 36, and a spring 48 extends in the chamber 46 and normally urges the piston upwardly, as will be described. In the position of FIG. 2A, the piston 40 is in its upper position in which its upper end engages the disc 34.

Before operation, the vessel chambers 38 and 46 are charged to a predetermined pressure with a quantity of inert gas such as air. This charging can be through suitable openings (not shown) formed through the walls of the vessel 32 and the cylinder 36. Alternatively, the chamber 46 is charged by removing the disc 34 and pulling the piston 40 upwardly until the lower O-ring 44 extends in the notch **36*b* of the cylinder 36. Then pressurized air is introduced from the upper opening 32*b* in the vessel 32, into the space between the piston 40 and the cylinder 36 and passes through the notch 36*a*. A portion of the air passes into the chamber 46 and a portion passes through the opening 36*a* and into the chamber 38**.

The piston 40 is then lowered to the position shown in FIG. 2*a* and the disc 34 placed in the position shown and secured in any known manner. In this position the O-ring 42 engages corresponding portions of the inner wall of the cylinder 36 to seal against the flow of the pressurized air from the chamber 38, through the space between the piston 40 and the cylinder 36, through the opening **32*b* and into the can 10; while the O-ring 44 seals against the passage of air to and from the chamber 46**.

The actuator 30 is then placed in the can 10 which contains the product to be dispensed, and the can is also charged to a predetermined pressure with an inert gas, such as air, which pressure is selected to be greater than the combined pressures of the air in the chamber 46 and the spring 48 which together act upwardly on the piston 40. After the can is sealed off, or closed, the pressure in the can acts through the opening **32*b* of the vessel 32 and on the upper end of the piston 40 to force it downwardly to the position shown in FIG. 2B. In this position, both O-rings 42 and 44 engage the inner wall of the cylinder 36 to prevent any flow of the pressurized air through the cylinder, and the upper 0-ring 42 extends between the opening 36*a* and the notch 36*b***.

The piston 40 remains in the position of FIG. 2B until the can 10 is used by manually pressing the push button 24, in which case the pressure in the can 10 propels the product through the tube 26, the valve 20, the stem 22 and outwardly through the openings in the push button 24. This causes the pressure in the can 10 to decrease until the pressures exerted on the lower end of the piston 40 by the pressure in the chamber 46 and the spring 48 are greater than the corresponding pressure acting on the upper end of the piston caused by the pressure in the can. Upon this occurring the piston 40 moves upwardly until the upper O-ring 42 extends in the notch **36*b* of the cylinder as shown in FIG. 2C. This permits the high pressure air in the chamber 38 to pass through the opening 36*a*, through the space between the outer surface of the piston 40 and the inner surface of the cylinder 36, through the notch 36*b* and outwardly through the upper opening 32*b* of the vessel 32**.

The pressure in the can 10 is thus increased accordingly until the pressure exerted thereby on the upper end of the piston 40 is sufficient to overcome the pressure exerted on the lower end of the piston by the spring 48 and the pressure in the chamber 46. At this time the piston 40 will move back to the position shown in FIG. 2B thus blocking any further flow of high pressure air from the chamber 38 into the can 10 as described above.

This back-and-forth movement of the piston 40 relative to the cylinder 36 continues in the manner described above as product is periodically dispensed from the can 10. As a result, a constant pressure will be available in the can 10 at all times to propel the product from the can, while the pressurizing medium utilized can be an inert gas, such as air, which is not harmful to the environment.

Figure 3A:
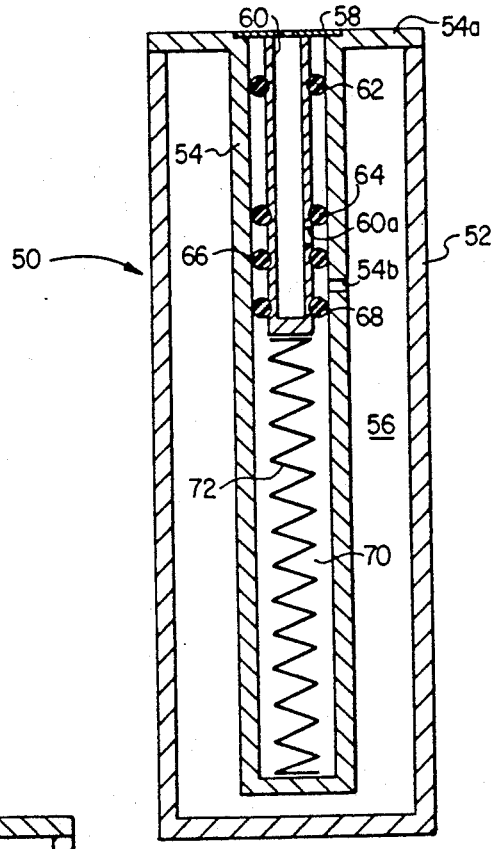
FIGS. 3A–3C and 4A–4C are views similar to FIGS. 2A–2C, but showing two alternate embodiments of the actuating apparatus of the present invention.
Figure 3B:
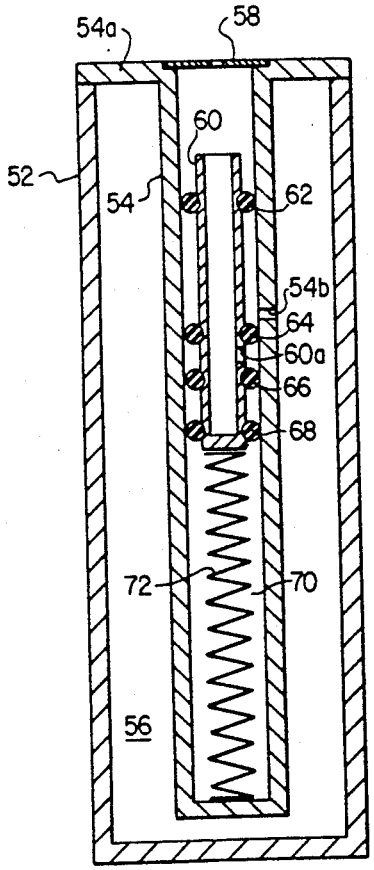
Figure 3C:
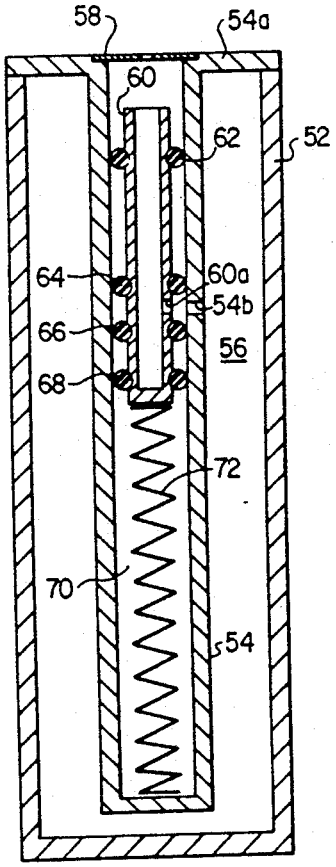

An alternate embodiment of the actuator of the present invention is shown in general by the reference numeral 50 in FIGS. 3A–3C which is also adapted to operate within the can 10. The actuator 50 is formed by a cylindrical vessel 52 having a closed lower end and an open upper end. A cylinder 54 is disposed in the vessel 52 and has a diameter and length less than those of the vessel 52 to define a high pressure chamber 56. The cylinder 54 is closed at its lower end and open at its upper end and includes an annular flange **54*a* that extends from its upper end over, and engagement with, the upper end of the vessel 52. An opening 54*b* is provided through the wall of the cylinder 54 and a disc 58 extends in a groove formed in the flange 54*a***.

A hollow piston 60 extends within the cylinder 54 in a coaxial relationship. The diameter of the piston 60 is less than the diameter of the cylinder 54 and the length of the piston is less than the length of the cylinder. Four axially spaced annular grooves are formed in the outer surface of the piston 60 and respectively receives four sealing members, preferably in the form of O-rings, 62, 64, 66, and 68 which engage the inner wall of the cylinder 54. An opening **60*a* is provided through the wall of the piston 60 and between the O-rings 64 and 66. The cylinder 54 and the piston 60 define a chamber 70 extending between the lower ends of each, and a spring 72 is disposed in this chamber which normally urges the piston 60 to its upper position of FIG. 3A in which its upper end engages the disc 58**.

The operation of the embodiment of FIGS. 3A–3C is similar to that of FIGS. 2A–2C. More specifically, chambers 56 and 70 are initially charged with high pressure inert gas, such as air, in a manner described in connection with the previous embodiment. The actuator 50 is placed in the can 10 and the can is pressurized with an inert gas, such as air, which causes the piston 60 to move to the position shown in FIG. 3B, i.e. with the opening **60*a* extending below the opening 54*b*, and with the O-ring 64 extending between these openings. In this position, the O-ring 62 blocks any flow of high pressure air from the chamber 56, through the opening 54*b* and outwardly through the upper opening of the cylinder 54 and into the can; while the remaining O-rings seal against any flow between the chambers 56 and 70. When the pressure in the can 10 is reduced a predetermined amount in response to use of the can as described above, the piston will move to the position shown in FIG. 3C, i.e. with the opening 60*a* in alignment with the opening 54*b*. In this position, the O-rings 64 and 66 respectively extend above and below the aligned openings 54*b* and 60*a*, to permit the high pressure air to pass through the latter openings, up the interior of the piston 60, out the open upper end of the cylinder 54 and into the can 10. As the pressure in the can 10 fluctuates with use, the piston 60** will move between the positions shown in FIGS. 2B and 2C as described above.

Figure 4A:
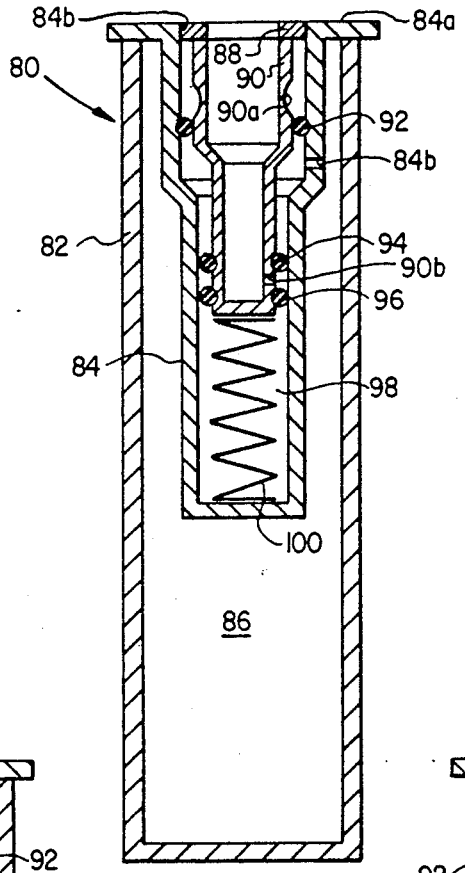
Figure 4B:
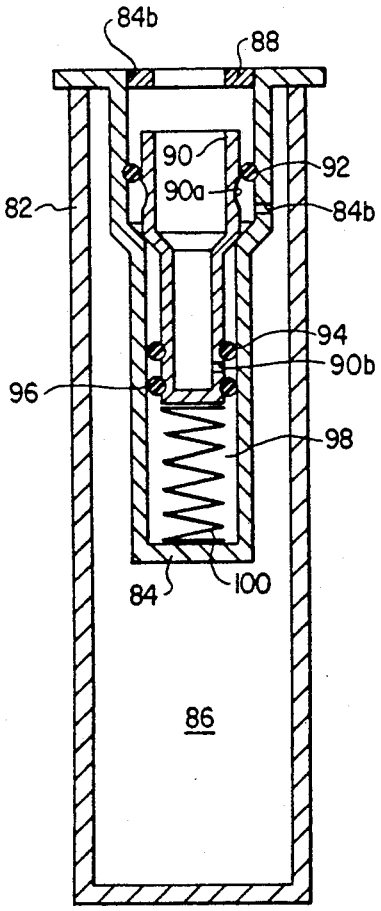
Figure 4C:
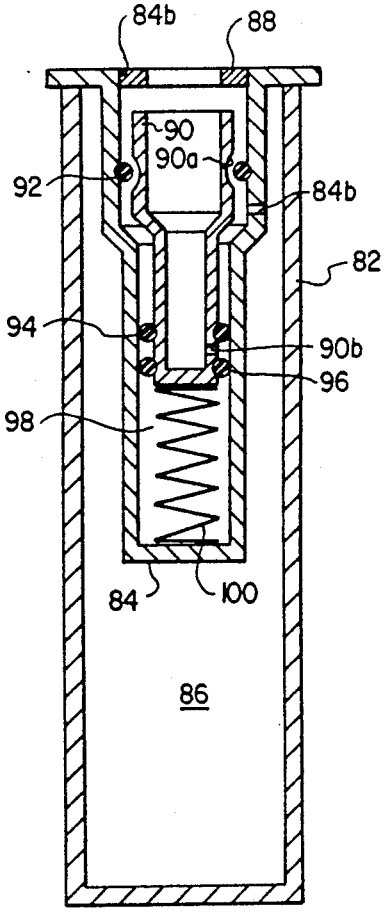

Another alternate embodiment of the actuator of the present invention is shown in general by the reference numeral 80 in FIGS. 4A–4C which is also adapted to operate within the can 10. The actuator 80 is formed by a cylindrical vessel 82 having a closed lower end and an open upper end. A cylinder 84 is disposed in the vessel 82 and has a stepped outer diameter and a length less than those of the vessel to define a high pressure chamber 86. The cylinder 84 is closed at its lower end and open at its upper end and includes an annular flange 84*a* that extends from its upper end over, and engagement with, the upper end of the vessel 82. An opening 84*b* is provided through the wall of the cylinder 84 and a disc 88 is secured to the inner wall of the upper end of the cylinder 84.

A hollow piston 90, having a stepped outer diameter complementary to the stepped outer diameter of the vessel 84, extends within the cylinder 84 in a coaxial relationship. The diameter of the piston 90 is less than the diameter of the cylinder 84 and the length of the piston is less than the length of the cylinder. An annular groove is disposed in the inner wall of the vessel 82 which receives a sealing member, such as an O-ring, 92 and two axially spaced annular grooves are formed in the outer surface of the piston 90 and respectively receives two sealing members, preferably in the form of O-rings, 94 and 96 which engage the inner wall of the cylinder 84. An annular notch 90*a* is formed in the outer wall of the piston 90 near its upper end and an opening 90*b* extends through the wall of the piston and between the O-rings 94 and 96 for reasons to be described. The cylinder 84 and the piston 90 define a chamber 98 extending between the lower ends of each, and a spring 100 is disposed in this chamber which normally urges the piston 80 to its upper position of FIG. 4A in which its upper end engages the disc 78.

The operation of the actuator 80 of FIGS. 4A–4C is similar to that of FIGS. 2A–2C. More specifically, the chambers 86 and 98 are initially charged with high pressure inert gas, such as air in a manner similar to the technique described in connection with the previous embodiments which would include raising the piston 90 until the O-rings entered the larger diameter portion of the cylinder, then charging the air through the piston to fill up the chambers 98 and 86 and then moving the piston to the position of FIG. 4A. The actuator 80 is placed in the can 10 (FIG. 1) and the can is pressurized with an inert gas, such as air, which causes the piston 90 to move to the position shown in FIG. 4B, i.e. with the O-ring 92 extending above the notch 90*a* and against the outer wall of the piston 90. In this position the O-ring blocks any flow of high pressure air from the chamber 86, through the opening 84*a* and the space between the outer wall of the piston 90 and the inner wall of the cylinder 84 and outwardly through the upper opening of the latter cylinder and into the can 10; while the O-rings 94 and 96 seal against any flow between the chambers 86 and 98. When the pressure in the can 10 is reduced a predetermined amount in response to use of the can as described above, the piston 90 will move to the position shown in FIG. 4C, i.e. with the O-ring 92 extending in the notch 90*a*. Thus, the high pressure air can pass through the opening 84*b* through the space between the piston 90 and the cylinder 84, out the open upper end of the cylinder 84 and into the can 10. At the same time the O-rings 94 and 96 prevent any flow of the high pressure air between the chambers 86 and 98. As the pressure in the can 10 fluctuates with use, the piston 90 will move between the positions shown in FIGS. 4B and 4C as described above. Thus the embodiment of FIGS. 4A–4C enjoys all of the advantages of the previous embodiments albeit in a different configuration.

It is understood that the discs 34, 58 and 88, the flanges 32*a*, 54*a* and 84*a* and the cylinders 36, 54 and 84 can be attached to their respective components in any known manner such as by welding, cementing, soldering or the like. Also the vessels, cylinders and the pistons, can each consist of a separate cylindrical wall and a bottom plate which are attached in the above matter.

It is also understood that several variations may be made in the foregoing. For example, the actuators 30, 50, and 80 have been shown and described as having a vertical orientation in the can 10 for convenience of presentation although they could take other orientations, such as horizontal. Also, the design could be such that the pistons 40, 60 and 90 are fixed and the cylinders 36, 54 and 84 move relative thereto. Further, the pressures in the chambers 46, 70 and 98 can be provided by high pressure gas alone or by a spring alone instead of the combination of both as disclosed above.

It is thus seen that the apparatus of the present invention provides several advantages, not the least significant of which is that it can utilize an inert gas such as air or nitrogen which is harmless to the environment. Also, it enables a precise constant pressure to be maintained in the can during use, is easily assembled and installed in the can and does not require any mechanical actuation before use.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. Apparatus for maintaining a constant predetermined pressure in a pressurized container for dispensing product contained in the container from the container at said constant pressure, said apparatus comprising:

a vessel disposed in said container, a cylinder member disposed in said vessel and defining with said vessel a first chamber for containing pressurized gas;

a piston member disposed in said vessel and defining with said cylinder member a second chamber;

one of said members being exposed to the pressure in said container for moving to a first position relative to the other member in response to said predetermined pressure in said container;

means in said second chamber for moving said one member to a second position relative to said other member in response to the pressure in said container decreasing below said predetermined pressure; and means responsive to said one member moving to said second position for connecting said first chamber with said container to permit said pressurized gas to pass from said first chamber to said container, said latter means being responsive to said one member moving to said first position for disconnecting said first chamber with said container to prevent said passages of said gas.

2. The apparatus of claim 1 wherein the pressure in said container decreases below said predetermined pressure in response to the dispensing of product from said container.

3. The apparatus of claim 1 wherein said cylinder member is secured relative to said vessel and said piston member is exposed to the pressure in said container and moves relative to said cylinder member to said first and second positions.

4. The apparatus of claim 3 wherein one end of said piston member is exposed to the pressure in said container and wherein said second chamber is defined between said cylinder member and the other end of said piston member.

5. The apparatus of claim 4 wherein said moving means comprises a spring and/or pressurized gas disposed in said second chamber and acting on said other end of said piston member.

6. The apparatus of claim 1 wherein the outer diameter of said piston member is slightly less than the inner diameter of said cylinder member to permit the flow of said pressurized gas therebetween from said first chamber to said container.

7. The apparatus of claim 6 wherein said connecting means comprises at least one sealing member extending between an outer surface of said piston member and a corresponding inner surface of said cylinder member for preventing said flow of pressurized gas when said piston member is in said first position, and a notch formed in one of said surfaces for receiving said sealing member for permitting said flow of pressurized gas when said piston member is in said second position.

8. The apparatus of claim 7 wherein said sealing member extends in a groove formed in said piston member and engages the inner surface of said cylinder member and wherein said notch is formed in the inner surface of said cylinder member.

9. The apparatus of claim 7 wherein said sealing member extends in a groove formed in said cylinder member and engages the outer surface of said piston member and wherein said notch is formed in the surface of said piston member.

10. The apparatus of claim 7 further comprising an additional sealing member extending between said surfaces and in a spaced relation to said first sealing member for preventing the flow of said pressurized gas to said second chamber.

11. Apparatus for dispensing a product comprising:

a container receiving said product, a vessel disposed in said container, a cylinder member disposed in said vessel and defining with said vessel a first chamber for containing pressurized gas;

a piston member disposed in said vessel and defining with said cylinder member a second chamber;

one of said members being exposed to the pressure in said container for moving to a first position relative to the other member in response to a predetermined pressure in said container;

means in said second chamber for moving said one member to a second position relative to said other member in response to the pressure in said container decreasing below said predetermined pressure; and means responsive to said one member moving to said second position for connecting said first chamber with said container to permit said pressurized gas to pass from said first chamber to said container, said latter means being responsive to said one member moving to said first position for disconnecting said first chamber with said container to prevent said passages of said gas.

12. The apparatus of claim 2 wherein the pressure in said container decreases below said predetermined pressure in response to the dispensing of product from said container.

13. The apparatus of claim 11 wherein said cylinder member is secured relative to said vessel and said piston member is exposed to the pressure in said container and moves relative to said cylinder member to said first and second positions.

14. The apparatus of claim 13 wherein one end of said piston member is exposed to the pressure in said container and wherein said second chamber is defined between said cylinder member and the other end of said piston member.

15. The apparatus of claim 14 wherein said moving means comprises a spring and/or pressurized gas disposed in said second chamber and acting on said other end of said piston member.

16. The apparatus of claim 11 wherein the outer diameter of said piston member is slightly less than the inner diameter of said cylinder member to permit the flow of said pressurized gas therebetween from said first chamber to said container.

17. The apparatus of claim 16 wherein said connecting means comprises at least one sealing member extending between an outer surface of said piston member and a corresponding inner surface of said cylinder member for preventing said flow of pressurized gas when said piston member is in said first position, and a notch formed in one of said surfaces for receiving said sealing member for permitting said flow of pressurized gas when said piston member is in said second position.

18. The apparatus of claim 17 wherein said sealing member extends in a groove formed in said piston member and engages the inner surface of said cylinder member and wherein said notch is formed in the inner surface of said cylinder member.

19. The apparatus of claim 17 wherein said sealing member extends in a groove formed in said cylinder member and engages the outer surface of said piston member and wherein said notch is formed in the surface of said piston member.

20. The apparatus of claim 17 further comprising an additional sealing member extending between said surfaces and in a spaced relation to said first sealing member for preventing the flow of said pressurized gas to said second chamber.

21. Apparatus for maintaining a constant predetermined pressure in a pressurized container for dispensing product contained in the container from the container at said constant pressure, said apparatus comprising:

a vessel disposed in said container, a first member disposed entirely in said vessel and defining with said vessel a first chamber for containing pressurized gas;

a second member disposed entirely in said vessel and defining with said first member a second chamber;

one of said members being exposed to the pressure in said container for moving to a first position relative to the other member in response to said predetermined pressure in said container;

means in said second chamber for moving said one member to a second position relative to said other member in response to the pressure in said container decreasing below said predetermined pressure; and means responsive to said one member moving to said second position for connecting said first chamber with said container to permit said pressurized gas to pass from said first chamber to said container, said latter means being responsive to said one member moving to said position for disconnecting said first chamber with said container to prevent said passages of said gas.

22. The apparatus of claim 21 wherein the pressure in said container decreases below said predetermined pressure in response to the dispensing of product from said container.

23. The apparatus of claim 21 wherein said second member is a cylinder and said first member is a piston disposed in said cylinder.

24. The apparatus of claim 23 wherein said cylinder is secured relative to said vessel and said piston is exposed to the pressure in said container and moves relative to said cylinder to said first and second positions.

25. The apparatus of claim 24 wherein one end of said piston is exposed to the pressure in said container and wherein said second chamber is defined between said cylinder and the other end of said piston.

26. The apparatus of claim 25 wherein said moving means comprises a spring and/or pressurized gas disposed in said second chamber and acting on said other end of said piston.

27. The apparatus of claim 23 wherein the outer diameter of said piston is slightly less than the inner diameter of said cylinder to permit the flow of said pressurized gas therebetween from said first chamber to said container.

28. The apparatus of claim 27 wherein said connecting means comprises at least one sealing member extending between an outer surface of said piston and a corresponding inner surface of said cylinder for preventing said flow of pressurized gas when said piston is in said first position, and a notch formed in one of said surfaces for receiving said sealing member for permitting said flow of pressurized gas when said piston is in said second position.

29. The apparatus of claim 28 wherein said sealing member extends in a groove formed in said piston and engages the inner surface of said cylinder and wherein said notch is formed in the inner surface of said cylinder.

30. The apparatus of claim 28 wherein said sealing member extends in a groove formed in said cylinder and engages the outer surface of said piston and wherein said notch is formed in the surface of said piston.

31. The apparatus of claim 28 further comprising an additional sealing member extending between said surfaces and in a spaced relation to said first sealing member for preventing the flow of said pressurized gas to said second chamber.

32. Apparatus for dispensing a product comprising:

a container receiving said product, a vessel disposed in said container, a first member disposed entirely in said vessel and defining with said vessel a first chamber for containing pressurized gas;

a second member disposed entirely in said vessel and defining with said first member a second chamber;

one of said members being exposed to the pressure in said container for moving to a first position relative to the other member in response to a predetermined pressure in said container;

means in said second chamber for moving said one member to a second position relative to said other member in response to the pressure in said container decreasing below said predetermined pressure; and means responsive to said one member moving to said second position for connecting said first chamber with said container to permit said pressurized gas to pass from said first chamber to said container, said latter means being responsive to said one member moving to said first position for disconnecting said first chamber with said container to prevent said passages of said gas.

33. The apparatus of claim 32 wherein the pressure in said container decreases below said predetermined pressure in response to the dispensing of product from said container.

34. The apparatus of claim 32 wherein said second member is a cylinder and said first member is a piston disposed in said cylinder.

35. The apparatus of claim 34 wherein said cylinder is secured relative to said vessel and said piston is exposed to the pressure in said container and moves relative to said cylinder to said first and second positions.

36. The apparatus of claim 35 wherein one end of said piston is exposed to the pressure in said container and wherein said second chamber is defined between said cylinder and the other end of said piston.

37. The apparatus of claim 36 wherein said moving means comprises a spring and/or pressurized gas disposed in said second chamber and acting on said other end of said piston.

38. The apparatus of claim 34 wherein the outer diameter of said piston is slightly less than the inner diameter of said cylinder to permit the flow of said pressurized gas therebetween from said first chamber to said container.

39. The apparatus of claim 38 wherein said connecting means comprises at least one sealing member extending between an outer surface of said piston and a corresponding inner surface of said cylinder for preventing said flow of pressurized gas when said piston is in said first position, and a notch formed in one of said surfaces for receiving said sealing member for permitting said flow of pressurized gas when said piston is in said second position.

40. The apparatus of claim 39 wherein said sealing member extends in a groove formed in said piston and engages the inner surface of said cylinder and wherein said notch is formed in the inner surface of said cylinder.

41. The apparatus of claim 39 wherein said sealing member extends in a groove formed in said cylinder and engages the outer surface of said piston and wherein said notch is formed in the surface of said piston.

42. The apparatus of claim 39 further comprising an additional sealing member extending between said surfaces and in a spaced relation to said first sealing member for preventing the flow of said pressurized gas to said second chamber.

* * * * *